United States Patent [19]

Evans

[11] Patent Number: 4,827,258

[45] Date of Patent: May 2, 1989

[54] TRAFFIC LIGHT CHANGE ANTICIPATION SYSTEM

[76] Inventor: Kirk B. Evans, 16448 E. Eglin St., Higley, Ariz. 85236

[21] Appl. No.: 163,522

[22] Filed: Mar. 3, 1988

[51] Int. Cl.[4] ..... G08G 1/096

[52] U.S. Cl. ..... 340/929; 340/907

[58] Field of Search ..... 340/84, 916, 926, 929, 340/111, 907, 815.1

[56] References Cited

U.S. PATENT DOCUMENTS 4,490,455 5/1986 Fritzinger ..... 340/907

*Primary Examiner*—Joseph A. Orsino
*Assistant Examiner*—Annie H. Chan
*Attorney, Agent, or Firm*—Charles P. Padgett, Jr.

[57] ABSTRACT

The present invention discloses a method and apparatus for enabling motorists to anticipate the change of a traffic signal from green to red in sufficient time to enable the motorist to either stop or proceed through the intersection by altering his or her speed for both fuel conservation and safety purposes. The control system of the present invention includes a timer wherein timing signals are used to control the on/off condition of the red, amber, and green lights of a traffic light signal apparatus, as indicated below. The green light begins its cycle for a first relatively long period of time. At some relatively short period of time prior to the end of the green light's cycle, the amber light comes "on" in a steady state or blinking condition simultaneously with the green. This enables motorists to anticipate the impending change of the light from green-to-amber-to-red in order that they can properly gauge their speed for both safety and fuel conservation purposes. After a relatively short period of time, the green light goes "off" and the amber continues "on, " normally as a conventional steady state amber light. At the end of the amber light cycle, the signal switches to red for a relatively long period of time before turinging the red "off" and the green "on" to begin the cycle anew.

20 Claims, 1 Drawing Sheet

TRAFFIC LIGHT CHANGE ANTICIPATION SYSTEM

BACKGROUND OF THE INVENTION

1. Field Of The Invention

This invention relates generally to a control system for a traffic light, and more particularly to a traffic light control system for enabling drivers to anticipate a change in a traffic signal from green to red so that they can properly adjust their speed for fuel conservation and safety purposes.

2. Description Of The Prior Art

Traffic control signaling devices are used at busy stree tand road intersections and are commonly employed to incorporate Stop and Go signals, These signals are electrically operated from a control box adjacent the traffic control signaling devices or adjacent a group or set of such devices. For predetermined periods or cycles of time, the Go and Stop signals, commonly respectively, colored green and red, are alternately displayed relative to a certain path of traffic movement. In this manner, while the green signals are giving the right of way to traffic headed in either of the two directions in which such signals face, the red signals are displayed to arrest traffic which otherwise would travel in the two directions faced by the red signals and which intersect the two former directions.

Early in the development of such traffic signaling devices, a third signal was added. This signal was amber or yellow to signify caution. Following the termination of each giving of red and green signals relative to traffic at a road or street intersection and before reversal of the signals to change the directions of traffic flow, the caution signal was displayed. Practice apparently proved, however, that the use of such caution signals was not entirely advantageous. In the early signaling devices using only red and green signals, the change-over from a Go to a Stop indication, and vice versa, was abrupt and sudden and of considerable inconvenience and even hazardous to pedestrians and drivers alike.

Since considerable difficulty was experienced by motorists in bringing their automobiles to a stop when a green light suddenly changed to red, the amber caution light was included, but this does not, by any means, represent a full solution to the problem, since the amber or yellow caution light remains on, usually, for only a very few seconds. Thus, the motorist may be approaching an intersection, maintaining a normal rate of speed sufficient in his or her judgement, to permit the driver to pass the intersection while he orshe still has a green light, and may be suddenly confronted with an imminent light change when he or she is almost at the intersection. Under these circumstances, it is necessary that the driver either bring the vehicle to a sharp or sudden stop, or alternately, continue on through the intersection despite the fact that the signal may be completely changed before he or she is fully through the intersection.

It will be seen from the above that it is highly desirable that the motorist be provided with a visual indication, from the time the signal changes until the next change thereof, that will provide him or her with full knowledge as to the amount of time remaining before the next signal change. In this way, the driver can prepare himself or herself further in advance, either for bringing the vehicle to a halt at the intersection, or alternatively, for preparing the vehicle to leave the intersection after it has been stopped thereat by a red stop light.

It has been heretofore proposed to provide a visual indication on a traffic light signal whereby one can determine, generally, the extent of time remaining before the next light change. Furthermore, systems have been devised which provide an improved type of device which is particularly adapted to provide a visual indication that can be seen at a substantial distance so that an oncoming motorist can readily perceive the extent of time in the signal cycle which remains before he or she reaches the intersection, and so that pedestrians can perceive the extent of time remaining in the signal cycle until they can cross safely through the intersection or during which they must wait before they can safely cross.

Many of the systems proposed by the prior art involve significant modifications too the hardward of the traffic signals themselves and significant changes in the control units therefore. This has proved too expensive to install, too difficult to maintain, and often to confusing to use safely.

It is desirable that the proposed changes to the traffic light control systems do not involve any significant amount of modification of the existing traffic control equipment, circuitry, or hardware. Systems have attempted to solve this problem more recently by blinking the green light near the end of its cycle before the amber light comes on and by blinking the red light at the end of its cycle before it reverts to green. Such signals are often confusing, and both drivers and pedestrians are not materially assisted in making safe decisions.

None of the systems of the prior art provide an extremely simple, yet relatively full-proof, method and apparatus for enabling a driver to anticipate a change in the traffic signal from green to red in sufficient time to safely judge whether or not to stop or proceed through the intersection. Applicant's invention solves relatively all of these prior art problems by providing a simple, low-cost, easy-to-install, easy-to-maintain, easy-to-operate system for enabling drivers and pedestrians alike to anticipate, without confusion, light changes for fuel conservation and safety purposes.

SUMMARY OF THE INVENTION

It is an object of the present invention to provide an improved method and apparatus for enabling motorists to anticipate the change in a traffic signal from green (Go) to red (Stop) so that they can adjust their speed for both fuel conservation and safety purposes.

It is another object of this invention to provide such a method and apparatus which does not require any physical change or modification whatsoever to the traffic light signal device itself and which does not require any substantial modification to the traffic light control system therefor.

It is a further object of the present invention to provide a traffic light signal wherein an amber or yellow caution light comes on in the last few seconds of the green light cycle and before the amber light is on alone to warn motorist that a green-to-amber-to-red transition is impending.

It is yet another object of the present invention to provide for the termination of the green signal while maintaining the amber signal on for its normal period of time prior to the signal switching to red.

It is still another object of this invention to provide a yellow or amber light which may operate in a blinking or flashing mode while it is simultaneously illuminated with the green light and in a steady state mode while in the normal amber or yellow light mode of operation.

The present invention is an improved light change anticipation system for use in a traffic signal controller for operating the individual colored traffic signal lights of a traffic signal apparatus having a red light indicating Stop, a green light indicating Go, and an amber or yellow light indicating to Proceed With Caution. The light change anticipation system includes means for turning "on" the green light at the beginning of its cycle. Means responsive to a first relatively long time duration are provided for turning "on" the amber light, possibly in a blinking or flashing mode of operation, while maintaining the green light "on" near the end of its cycle. Means responsive to a first relatively short time duration are provided for then turning the green light "off", while maintaining the amber light "on" to warn motorists that the light will shortly change to red. Means responsive to a second relatively short duration of time are provided for simultaneously turning the amber or yellow light "off" and the red light "on" to begin its cycle. Furthermore, means are provided which are responsive to a second relatively long time duration for simultaneously turning the red light "off" and the green light "on" to begin the traffic control signal sequence over again.

Means may be provided for flashing or blinking the amber light "on" and "off" during that time in which it is simultaneously illuminated with the green light. The first relatively long time period of the green light cycle is approximately equal to the second relatively long period of the red light cycle. Similarly, the relatively short period that the amber light is on with the green is approximately equal to that period which the amber light is on alone.

The present invention also contemplates a method of operating traffic lights at an intersection wherein the traffic lights include a red light indicating Stop, a green light indicating Go, and yellow or amber light indicating to Proceed With Caution. The method includes the steps of turning "on" the green light at the beginning of its cycle and maintaining the green light "on" for a time duration $t_1$. The method then includes the step of turning "on" the amber light at a time $t_1-x$, where "x" is a relatively short time interval of approximately 3–8 seconds. The method then contemplates turning "off" the green light at the end of the period $t_1$ while maintaining the amber light "on" for a second relatively short time duration $t_2$, where $t_2 << t_1$ and is approximately equal to 3 to 8 seconds. The method then contemplates simultaneously tuning the red light "on" and the amber light "off". The red light is then maintained "on" for a time duration period $t_3$ and finally then turning the red light "off" and the green light "on" at the end of the period $t_3$ to restart the cycle again.

In a typical operation, the time period $t_1$ of the green light and the time period $t_3$ of the red light are approximately equal. Furthermore, the time duration of the period "x," during which the yellow light is "on" simultaneously with the green light, is approximately equal to the time period in which the yellow or amber light is on by itself. Preferably, the green light cycle period and the red light cycle periods $t_1$ and $t_3$ are in the range of 30 to 120 seconds while the relatively short time periods "x" and $t_2$ are in the range of 3 to 8 seconds. Lastly, the method may contemplate the step of blinking or flashing the amber light while it is "on" simultaneously with the green light in order to differentiate it from the period that the yellow or amber light is steady or continuously on by itself to enable motorist and pedestrians alike to anticipate the impending change of the light and adjust their speed accordingly for both safety and fuel conservation purposes.

These and other objects and advantages of the present invention will be more fully understood after reading the detailed description of the preferred embodiment, the claims, and the drawings, which are briefly described hereinbelow.

DETAILED DESCRIPTION OF THE PREFERRED EMBODIMENT

Figure 1:
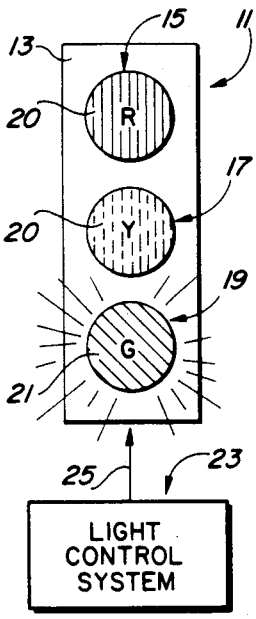
FIG. 1 is a schematic illustration of a traffic signal light apparatus and control system therefore with the green light in the "on" condition.

FIG. 1 shows a traffic signal apparatus 11 having four faces, of which only the face of concern 13 is illustrated. The face 13 is shown as including a red stop light 15, an amber or yellow caution light 17, and a green Go light 19. The reference numeral 20 indicates that a particular light is off, and in Figure 1, the green light 19 is "on," as represented by reference numeral 21. A conventional light control system, as indicated by block 23, is provided, and control signals 25 pass from the light control system 23 to the traffic signal apparatus 11, as conventionally known in the art.

Figure 2:
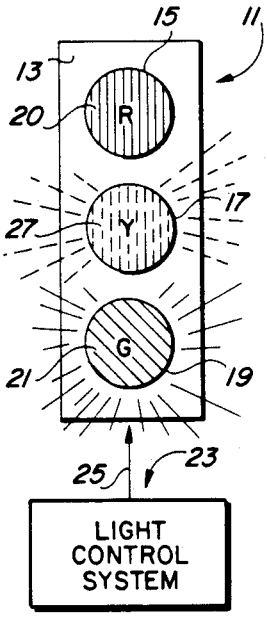
FIG. 2 is a schematic illustration of a traffic signal light apparatus and control system therefore wherein the green light is "on" simultaneously with the yellow or amber light, which may be blinking or flashing.

FIG. 2 illustrates the traffic signal apparatus of FIG. 1 wherein the red light 15 is "off," as indicated by reference numeral 20, while the amber or yellow light 17 is "on," as indicated by reference numeral 27, simultaneously with the illumination of the green light 19 which is "on" as represented by reference numeral 21.

Figure 3:
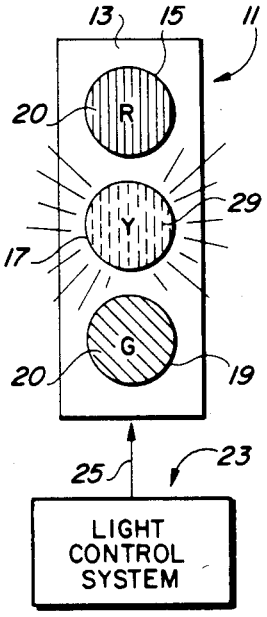
FIG. 3 is a schematic illustration of a traffic signal light apparatus and control system therefore wherein the yellow amber light is "on;"
Figure 4:
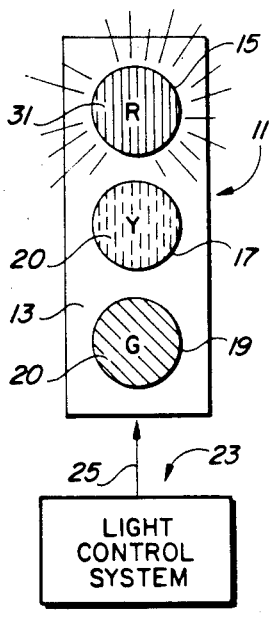
FIG. 4 is a schematic illustration of a traffic signal light apparatus and control system therefore wherein the red light is "on;"

In FIG. 3, both the red light 15 and the green light 19 are "off," as represented by reference numeral 20, while the yellow or amber light 17 is "on" in a steady state condition as indicated by reference numeral 29. Lastly, FIG. 4 illustrates the traffic signal apparatus 11 of FIG. 1 wherein the red light 15 is "on" as indicated by reference numeral 31, while the yellow or amber light 17 and green light 19 are "off" as indicated by the reference numerals 20.

These four Figures illustrate the sequence of operation of the system of the present invention which will be described hereinafter with reference to FIGS. 6 and 7.

Figure 5:
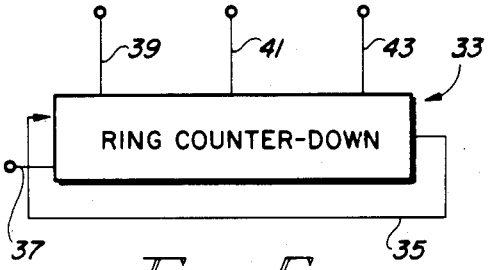
FIG. 5 (PRIOR ART)
FIG. 5 is a schematic illustration of a ring container illustrating the operation of the control system of the prior art.

FIG. 5 illustrates a ring counter of the Prior Art which begins its timing sequence at some initial time and counts down to a second time wherein the cycle is again restarted by the feedback loop 35. The clock signals which are counted are provided to the input 37, as known in the art. The output lead 39 which would be connected to the traffic signal apparatus 11 of Figures 1 through 4 of the prior art, supplies a signal for turning "on" the green light. Lead 41 transmits a signal for turning "off" the green light and for simultaneously turning the yellow or amber light "on," whereas lead 43 provides a signal for turning "off" the yellow or amber light and turning "on" the red light. The duration of the red light continues through its time cycle and then it is turned "off" simultaneously with the turning "on" of the green light, via a control signal on lead 39 at the beginning of the next traffic light timing cycle.

Figure 6:
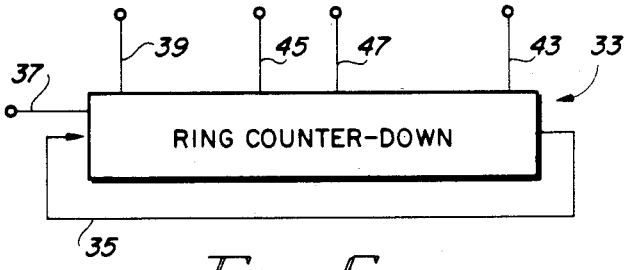
FIG. 6 is an electrical schematic diagram of a ring counter illustrating the operation of the control system of the present invention.
Figure 7:
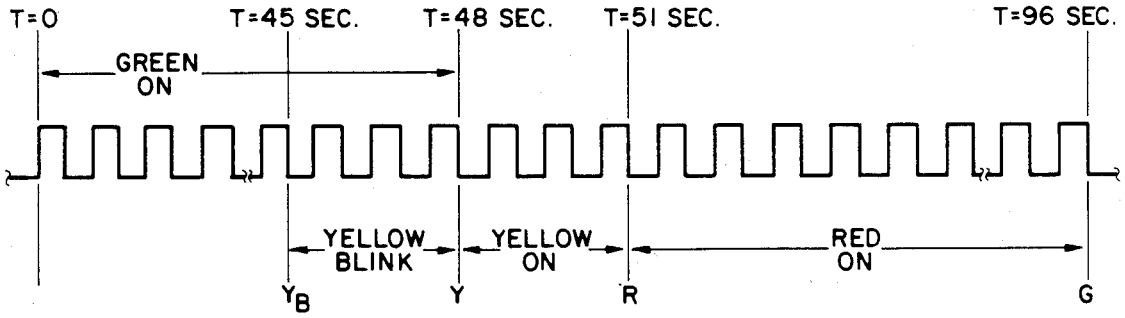
FIG. 7 is a timing diagram indicating one possible traffic light sequence of the present invention

The improvement of the traffic control system contemplated by the present invention is illustrated rather simply in FIGS. 6 and 7. FIG. 6 represents an electrical ring counter 33 having a feedback loop 35 and a clock input 37. The output 39 supplies signals from the counter 33 of the traffic control apparatus 11, via lead 39, for turning the green light "on" at the beginning of its cycle. Lead 45 provides a signal for turning the yellow or amber light "on" while the green light remains "on." This signal may also be used for blinking or flashing the yellow or amber light, if desired. The lead 47 then provides a signal to the traffic signal apparatus 11 for turning "off" the green light and turning the amber or caution light "on" in a steady state mode of operation for a relatively short period. At the end of that period, the signal on lead 43 turns "off" the yellow light and turns "on" the red light for its cycle duration which continues until the red light is turned "off" and the green light is turned "on," via the signal on lead 39, to begin the next timing cycle or sequence.

The timing diagram of FIG. 7 illustrates that the green light is turned "on" at time t=0. In the preferred embodiment, the green light remains "on" for 48 seconds. During this duration, 45 seconds are counted down until the yellow or amber light, either in a steady state mode or in a flashing mode, is turned "on" at time t=45 seconds. The yellow light remains "on" simultaneously with the green light until the time t=48 seconds. At this time, the yellow or amber light remains "on" in a steady state mode of operation, and the green light is turned "off." At a time t=51 seconds, the amber light is turned "off" and the red light is turned "on" for a period of 45 seconds until t=96 seconds. At time t=96 seconds, the counter recycles and begins the green "on" cycle simultaneously with the turn "off" of the red at time t=0 to begin or repeat the cycle anew.

It will be obvious to those of ordinary skill in the art that various modifications, changes, variations, alterations, substitutions, and the like including variations in cycle times, on-off periods, rate of flashing, etc. can be made in the present invention without departing from the spirit and scope thereof which is limited only by the appended claims.

I claim:

1. A light change anticipation system for use in a traffic signal controller for operating the individual colored lights of a traffic signal apparatus having a red light to indicate Stop, a green light to indicate Go, and an amber light to indicate "proceed with caution," said light change anticipation system comprising:

means for turning "on" said green light at the beginning of a traffic light cycle;

means responsive to the end of a first relatively long time period for turning "on" said amber light while maintaining said green light "on;"

means responsive to the expiration of a first relatively short time period for turning "off" the green light while maintaining the amber light "on" to warn motorist that the traffic signal light will shortly turn red;

means responsive to the elapse of a second relatively short time interval for simultaneously turning said amber light "off" and said red light "on;" and means responsive to the end of a second relatively long time period for simultaneously turning said red light "off and said green light on" to begin the traffic cycle anew.

2. The light change anticipation system of claim 1 wherein said means responsive to the end of a first relatively long time period for turning "on" said amber light includes means for flashing said amber light during said first relatively short time period.

3. The light change anticipation system of claim 1 wherein said first relatively long time period plus said first relatively short time period is approximately equal to said second relatively long period.

4. The light change anticipation system of claim 3 wherein said first relatively short time period is substantially equal to said second relatively short time interval.

5. The light change anticipation system of claim 4 wherein said first relatively long time period plug said first relatively short time period lies within the range of 30 to 120 seconds, wherein said first relatively short time period lies in the range of 3 to 8 seconds, wherein said second relatively short time interval lies within the range of 3 to 8 second and while said second relatively long time period lies within the range of 30 to 120 seconds.

6. A method of operating a traffic signal light having a red light indicating Stop, a green light indicating Go, and an amber light indicating proceed with caution, said method comprising the steps of:

turning "on" said green light;

maintaining said green light "on" for a time duration $t_1$;

turning "on" said amber light at a time $t_1-x$, where "x" is a relatively short time interval;

turning "off" the green light while maintaining the amber light on at said time $t_1$;

maintaining said amber light "on" by itself for a time duration $t_2$, where $t_2 << t_1$;

simultaneously turning the red light "on" for a time duration $t_3$ and the amber light "off" at the time $t_1+t_2$; and simultaneously turning the red light "off" and the green light "on" at the end of the period $t_3$ to restart the timing cycle again.

7. The method of claim 6 wherein the time period $t_1$ is approximately equal to the time period $t_3$.

8. The method of claim 7 wherein the time period "x" is approximately equal to the time period $t_2$.

9. The method of claim 6 wherein said time periods $t_1$ and $t_3$ lie within the range of 30 to 120 seconds and the time periods "x" and $t_2$ lie within the range of 3 to 8 seconds.

10. The method of claim 6 wherein said turning "on" said amber light at a time $t_1-x$ includes flashing the amber light periodically while the green light is "on" during the time interval "x."

11. The light change anticipation system of claim 1 wherein said means responsive to the end of a first relatively long time period for turning said amber light "on" while maintaining said green light "on" includes means for maintaining said amber light continuously "on" during said first relatively short time period and continuously "on" during said second relatively short time period.

12. The light change anticipation system of claim 1 wherein said means responsive to the end of a first relatively long time period for turning said amber light "on" includes means for maintaining said amber light continuously on during said first relatively short time period and for flashing said amber light during said second relatively short time period.

13. The light change anticipation system of claim 1 wherein said means responsive to the end of a first relatively long time period for turning said amber light "on" includes means for flashing said amber light during said first relatively short time period and for flashing said amber light during said second relatively short time period.

14. The light change anticipation system of claim 1 wherein said means responsive to the end of a first relatively long time period for turning said amber light "on" includes means for flashing said amber light during said first relatively short time period and for maintaining said amber light continuously "on" during said second relatively short time period.

15. The light change anticipation system of claim 1 wherein said first relatively short time period includes at least a discernable time duration.

16. The method of claim 6 wherein turning "on" said amber light at a time $t_1-x$ includes flashing said amber light for the time interval "x" while said green light is continuously on, and wherein maintaining said amber light on by itself for a time duration $t_2$ includes maintaining said amber light continuously or during said time duration $t_2$.

17. The method of claim 6 wherein turning on said amber light at a time $t_1-x$ includes maintaining said amber light continuously "on" for the time interval "x" while said green light is continuously "on", and wherein maintaining said amber light "on" by itself for a time duration "$t_2$" includes maintaining said amber light continuously "on" during said time duration "$t_2$".

18. The method of claim 6 wherein turning on said amber light at a time $t_1-x$ includes flashing said amber light during the time interval "x" while said green light is continuously on, and wherein maintaining said amber light "on" by itself for a time duration "$t_2$" includes maintaining said amber light continuously "on" for said time duration "$t_2$".

19. The method of claim 6 wherein turning on said amber light at a time $t_1-x$ includes maintaining said amber light continuously "on" during said time interval "x" while said green light is continuously "on", and wherein maintaining said amber light "on" by itself for a time duration "$t_2$" includes maintaining said amber light continuously "on" during said time duration "$t_2$".

20. The method of claim 6 wherein the time period "x" has at least a discernable time duration.

* * * * *